US009163839B2

(12) United States Patent
Westmoreland et al.

(10) Patent No.: US 9,163,839 B2
(45) **Date of Patent: *Oct. 20, 2015**

(54) MICROMIXER COMBUSTION HEAD END ASSEMBLY

(75) Inventors: James Harold Westmoreland, Greenville, SC (US); Patrick Benedict Melton, Greenville, SC (US)

(73) Assignee: General Electric Company, Schenectady, NY (US)

( * ) Notice: Subject to any disclaimer, the term of this patent is extended or adjusted under 35 U.S.C. 154(b) by 253 days.

This patent is subject to a terminal disclaimer.

(21) Appl. No.: 13/423,894

(22) Filed: Mar. 19, 2012

(65) Prior Publication Data

US 2013/0241089 A1 Sep. 19, 2013

(51) Int. Cl.
*B01F 3/04* (2006.01)
*F23R 3/28* (2006.01)

(52) U.S. Cl.
CPC ..... *F23R 3/286* (2013.01)

(58) Field of Classification Search
CPC ..... F23R 3/28; F23R 4/286; F23R 3/343; F23R 3/14; F23R 3/00; B01F 5/04; B01F 5/0413; B01F 4/0428
See application file for complete search history.

(56) References Cited

U.S. PATENT DOCUMENTS 4,100,733 A * 7/1978 Striebel et al. ..... 60/39.463
6,397,602 B2 * 6/2002 Vandervort et al. ..... 60/737
8,157,189 B2 * 4/2012 Johnson et al. ..... 239/132.5
8,181,891 B2 * 5/2012 Ziminsky et al. ..... 239/430
8,205,452 B2 * 6/2012 Boardman et al. ..... 60/737
8,276,385 B2 * 10/2012 Zuo et al. ..... 60/737
8,424,311 B2 * 4/2013 York et al. ..... 60/737
8,438,851 B1 * 5/2013 Uhm et al. ..... 60/737
8,511,092 B2 * 8/2013 Uhm et al. ..... 60/772
8,590,311 B2 * 11/2013 Parsania et al. ..... 60/737
8,616,002 B2 * 12/2013 Kraemer et al. ..... 60/737
2003/0014975 A1 * 1/2003 Nishida et al. ..... 60/737
2003/0101729 A1 * 6/2003 Srinivasan ..... 60/776
2004/0060295 A1 * 4/2004 Mandai et al. ..... 60/725
2010/0031662 A1 * 2/2010 Zuo ..... 60/740
2010/0186413 A1 7/2010 Lacy
2010/0192579 A1 * 8/2010 Boardman et al. ..... 60/737
2010/0218501 A1 9/2010 York
2010/0242493 A1 9/2010 Cihlar et al.
2010/0275601 A1 * 11/2010 Berry et al. ..... 60/737
2010/0287942 A1 * 11/2010 Zuo et al. ..... 60/772
2011/0016866 A1 * 1/2011 Boardman et al. ..... 60/730
2011/0057056 A1 * 3/2011 Ziminsky et al. ..... 239/398
2011/0083439 A1 * 4/2011 Zuo et al. ..... 60/737
2011/0113783 A1 * 5/2011 Boardman et al. ..... 60/723
2011/0265482 A1 * 11/2011 Parsania et al. ..... 60/740
2012/0055167 A1 * 3/2012 Johnson et al. ..... 60/776
2012/0079829 A1 * 4/2012 Berry et al. ..... 60/772
2014/0190169 A1 7/2014 Melon et al.

* cited by examiner

*Primary Examiner* — Amber Orlando
(74) *Attorney, Agent, or Firm* — Sutherland Asbill & Brennan LLP

(57) ABSTRACT

Embodiments of the present application can provide systems and methods for a micromixer combustion head end assembly. The micromixer may include one or more base nozzle structures. The base nozzle structures may include coaxial tubes. The coaxial tubes may include an inner tube and an outer tube. The micromixer may also include one or more segmented mixing tube bundles at least partially supported by a respective base nozzle structure. Moreover, the micromixer may include an end cap assembly disposed about the one or more segmented mixing tube bundles.

9 Claims, 4 Drawing Sheets

MICROMIXER COMBUSTION HEAD END ASSEMBLY

FIELD OF THE INVENTION

Embodiments of the present application relate generally to gas turbine engines and more particularly to micromixers.

BACKGROUND OF THE INVENTION

Gas turbine efficiency generally increases with the temperature of the combustion gas stream. Higher combustion gas stream temperatures, however, may produce higher levels of undesirable emissions such as nitrogen oxides (NOx) and the like. NOx emissions generally are subject to governmental regulations. Improved gas turbine efficiency therefore must be balanced with compliance with emissions regulations.

Lower NOx emission levels may be achieved by providing for good mixing of the fuel stream and the air stream. For example, the fuel stream and the air stream may be premixed in a Dry Low NOx (DLN) combustor before being admitted to a reaction or a combustion zone. Such premixing tends to reduce combustion temperatures and NOx emissions output.

In current micromixer designs, there may be multiple fuel feeds and/or liquid cartridge or blank feeds that obstruct air flow and decrease the mixing of fuel and air. Also, current micromixers are generally supported by external walls that inhibit air flow to the head end of the micromixer. Accordingly, there is a need for a micromixer that better facilitates fuel and air mixing.

BRIEF DESCRIPTION OF THE INVENTION

Some or all of the above needs and/or problems may be addressed by certain embodiments of the present application. According to one embodiment, there is disclosed a micromixer. The micromixer may include one or more base nozzle structures. The base nozzle structures may include coaxial tubes. The coaxial tubes may include an inner tube and an outer tube. The micromixer may also include one or more segmented mixing tube bundles at least partially supported by a respective base nozzle structure. Moreover, the micromixer may include an end cap assembly disposed about the one or more segmented mixing tube bundles.

According to another embodiment, there is disclosed a micromixer. The micromixer may include a base nozzle structure. The base nozzle structures may include coaxial tubes. The coaxial tubes may include an inner tube and an outer tube. The micromixer may also include a plurality of mixing tubes forming a segmented mixing tube bundle that is at least partially supported by a respective base nozzle structure. Moreover, the micromixer may include a removable end cap assembly disposed about the the segmented mixing tube bundle.

Further, according to another embodiment, there is disclosed a micromixer. The micromixer may include one or more base nozzle structures. The micromixer may also include one or more segmented mixing tube bundles at least partially supported by a respective base nozzle structure. Moreover, the micromixer may include an end cap assembly disposed about the one or more segmented mixing tube bundles.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE INVENTION

Illustrative embodiments will now be described more fully hereinafter with reference to the accompanying drawings, in which some, but not all embodiments are shown. The present application may be embodied in many different forms and should not be construed as limited to the embodiments set forth herein. Like numbers refer to like elements throughout.

Figure 1:
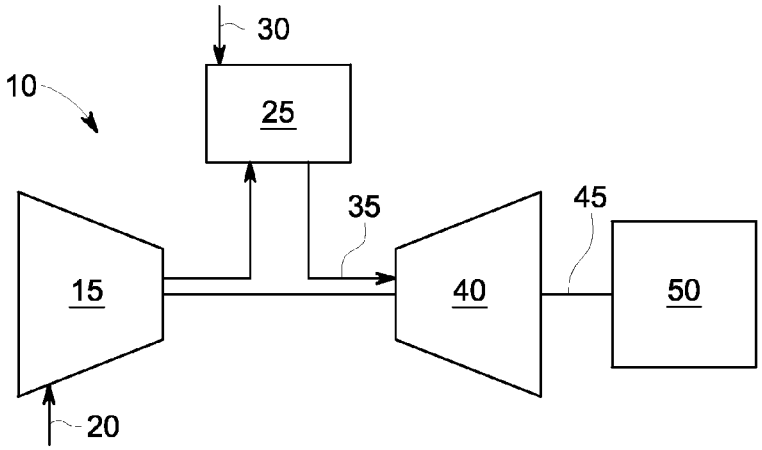
FIG. 1 (PRIOR ART)
FIG. 1 is a schematic of an example diagram of a gas turbine engine with a compressor, a combustor, and a turbine, according to an embodiment.

Illustrative embodiments are directed to, among other things, micromixers for a combustor. FIG. 1 shows a schematic view of a gas turbine engine 10 as may be used herein. As is known, the gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components.

Other types of gas turbine engines also may be used herein. Multiple gas turbine engines, other types of turbines, and other types of power generation equipment also may be used herein together.

Figure 2:
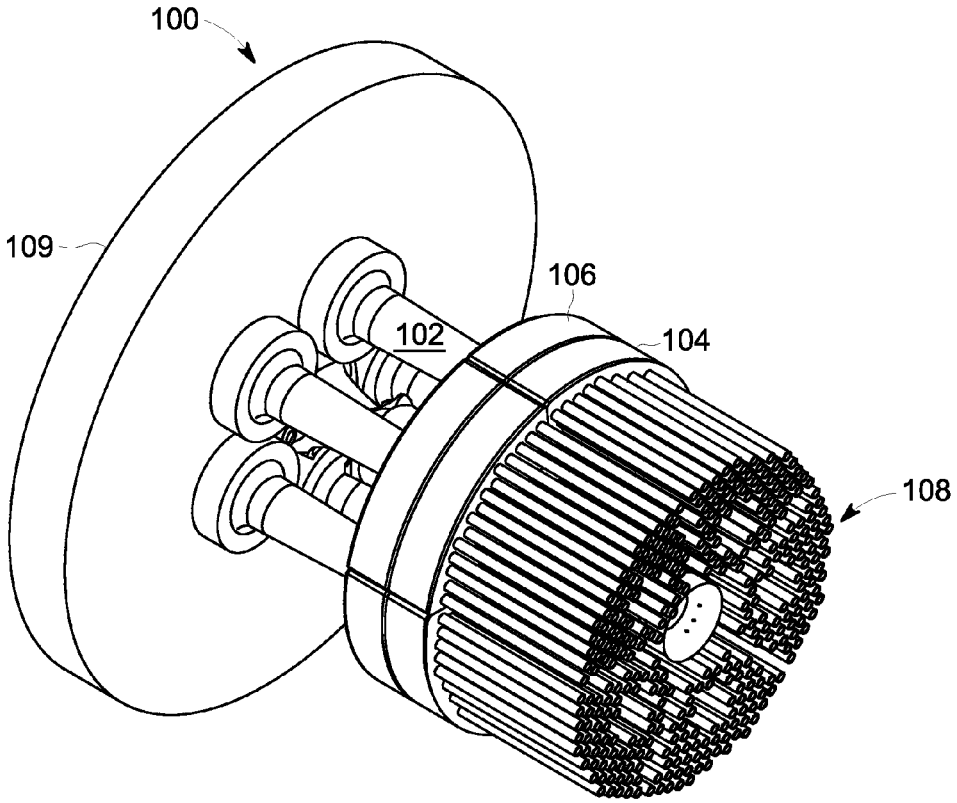
FIG. 2 is a perspective view of a micromixer, according to an embodiment.
Figure 3:
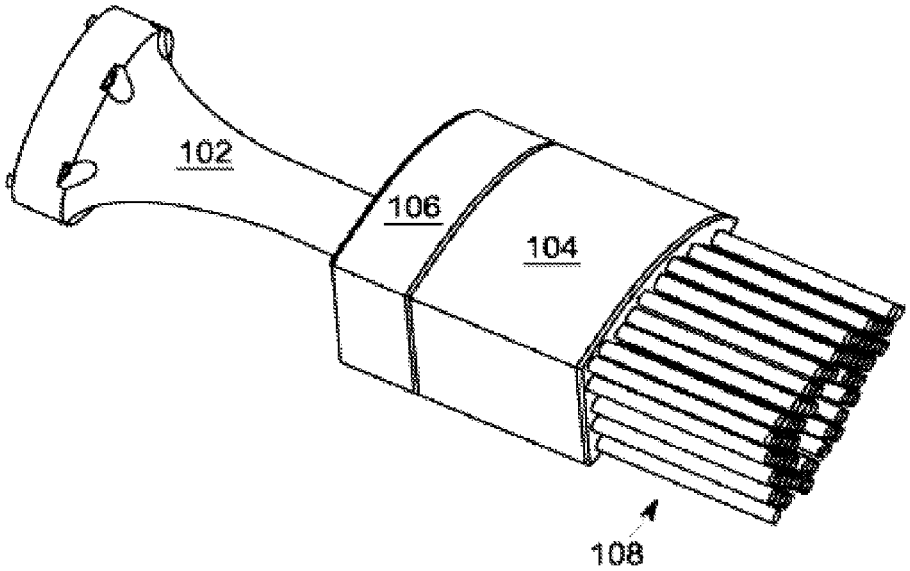
FIG. 3 is a perspective view of a portion of a micromixer, according to an embodiment.

FIGS. 2 and 3 depict a component of the combustor 25 in FIG. 1; specifically, a micromixer 100 or a portion thereof. The micromixer 100 may include a base nozzle structure 102 in communication with a fuel plenum 104, an air intake 106, and numerous mixing tubes 108 forming one or more segmented mixing tube bundles. The base nozzle structure 102 supplies a fuel to the fuel plenum 104. The fuel exits the fuel plenum 104 and enters the mixing tubes 108. Air is directed into the mixing tubes 108 through the air intake 106 and mixes with the fuel to create an air/fuel mixture. The air/fuel mixture exits the mixing tubes 108 and enters into a downstream combustion chamber.

Still referring to FIGS. 2 and 3, the micromixer 100 may be segmented, meaning the micromixer 100 may include a number of base nozzle structures 102. In the segmented micromixer 100, each base nozzle structure 102 is associated with a bundle of mixing tubes 108 that are at least partially supported by the base nozzle structure 102. The base nozzle structures 102 may be attached to a combustor endplate 109.

Figure 4:
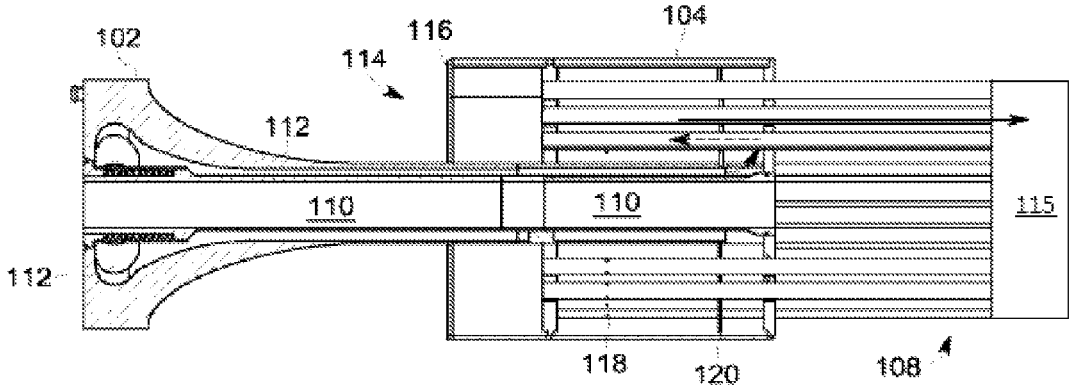
FIG. 4 is a cross-section of an example diagram of a portion of a micromixer, according to an embodiment.

As depicted in FIG. 4, the micromixer 100 may include the base nozzle structure 102 having coaxial tubes including an inner tube 110 and an outer tube 112. The outer tube 112 of the coaxial tubes supplies a fuel to the mixing tubes 108. In certain embodiments, the inner tube 110 of the coaxial tubes supplies a liquid cartridge or blank to the combustion chamber 115. In other embodiments, the inner tube 110 of the coaxial tube may include an igniter or flame detector. One will appreciate, however, that the inner tube 110 of the coaxial tubes may include a variety of combustor components.

An air inlet 114 is disposed upstream of the mixing tubes 108 and supplies air to the mixing tubes 108. In certain embodiments, an air conditioner plate 116 may be disposed upstream of the mixing tubes 108.

The fuel supplied by the outer tube 112 of the coaxial tubes enters the fuel plenum 104 before entering the mixing tubes 108. In certain embodiments, the fuel entering the fuel plenum 104 is redirected 180 degrees (as indicated by the dashed arrows at the end of outer tube 112) before entering the mixing tubes 108 through one or more holes 118 in the mixing tubes 108. In other embodiments, the fuel enters the fuel plenum 104 directly without being redirected.

In certain embodiments, a fuel conditioning plate 120 is disposed within the fuel plenum 104. In other embodiments, the fuel plenum 104 does not include the fuel conditioning plate 120. The air/fuel mixture exits the mixing tubes 108 (as indicated by the solid arrow within the mixing tubes 108) into the combustion chamber 115.

The base nozzle structure 102 of the micromixer 100 provides both structural support and an outer tube 112 for the fuel to enter the fuel plenum 104. As stated above, the fuel can be gas. The inner tube 110 may include a liquid cartridge (for dual fuel), a blank cartridge (for gas only), an igniter, a flame detector, or any other combustor component. The base nozzle structure 102 is attached to the inlet plate 116 of the micromixer assembly. The fuel is injected from the end cover 109 into the base nozzle structure 102 and flows through the annulus formed between inner tube 110 and the outer tube 112 into the fuel plenum 104. The fuel then enters the mixing tube holes 118 where it is mixed with head end air. The head end air flows through the flow conditioning plate 116 and into the mixing tube 108.

Figure 5:
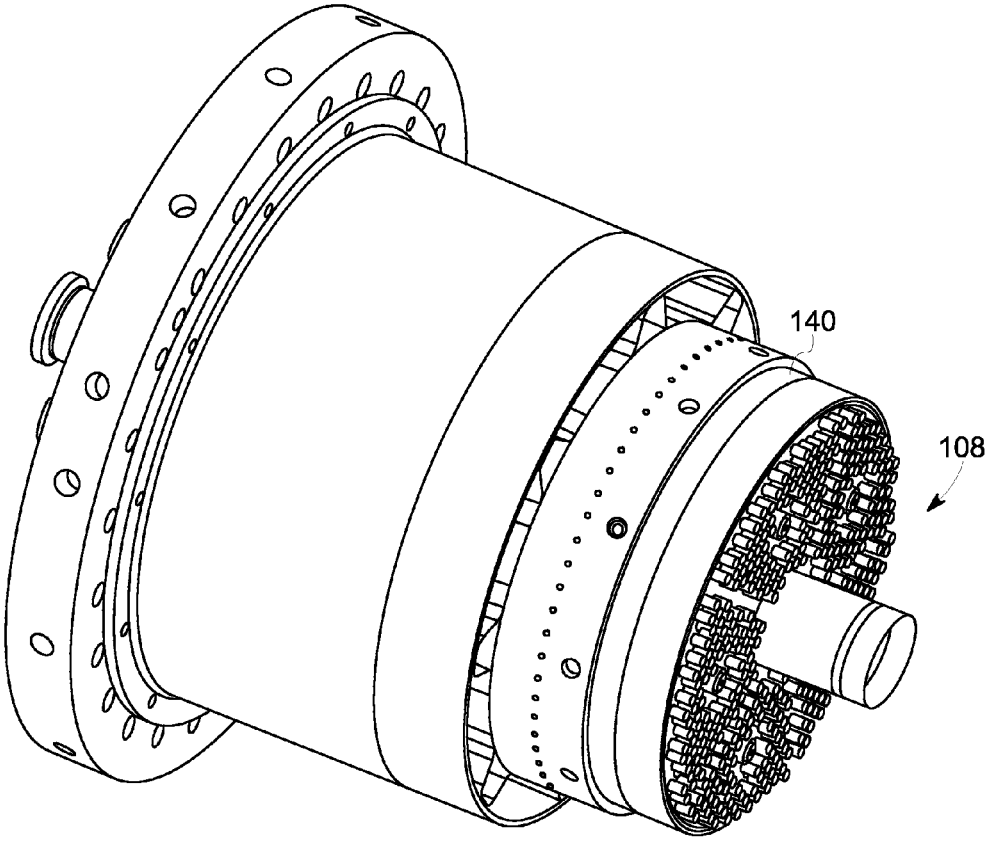
FIG. 5 is a perspective view of a portion of a micromixer, according to an embodiment.
Figure 6:
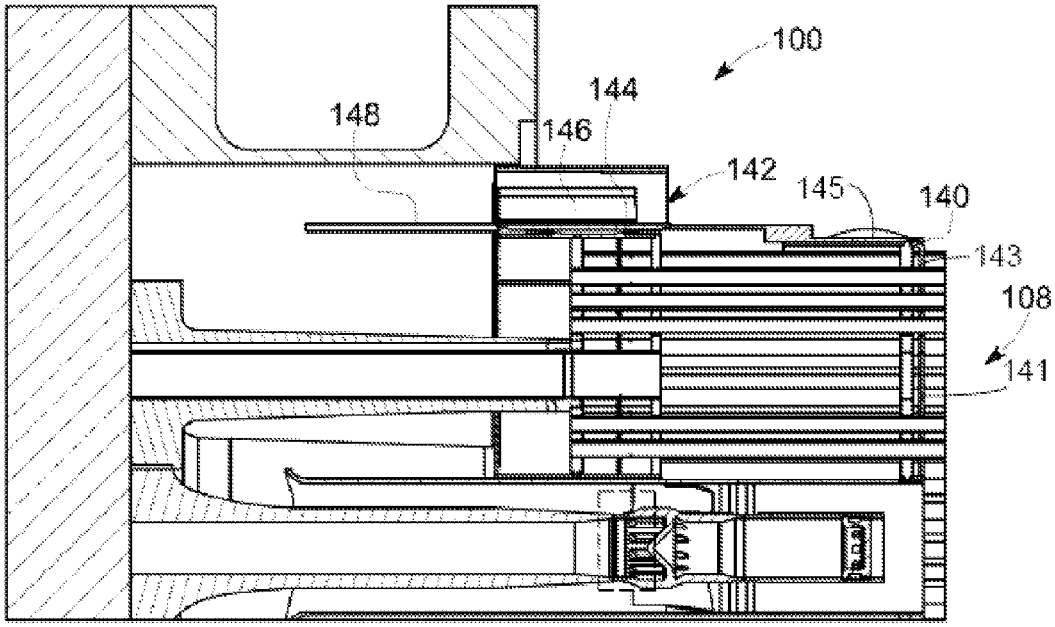
FIG. 6 is a cross-section of an example diagram of a portion of a micromixer, according to an embodiment.
Figure 7:
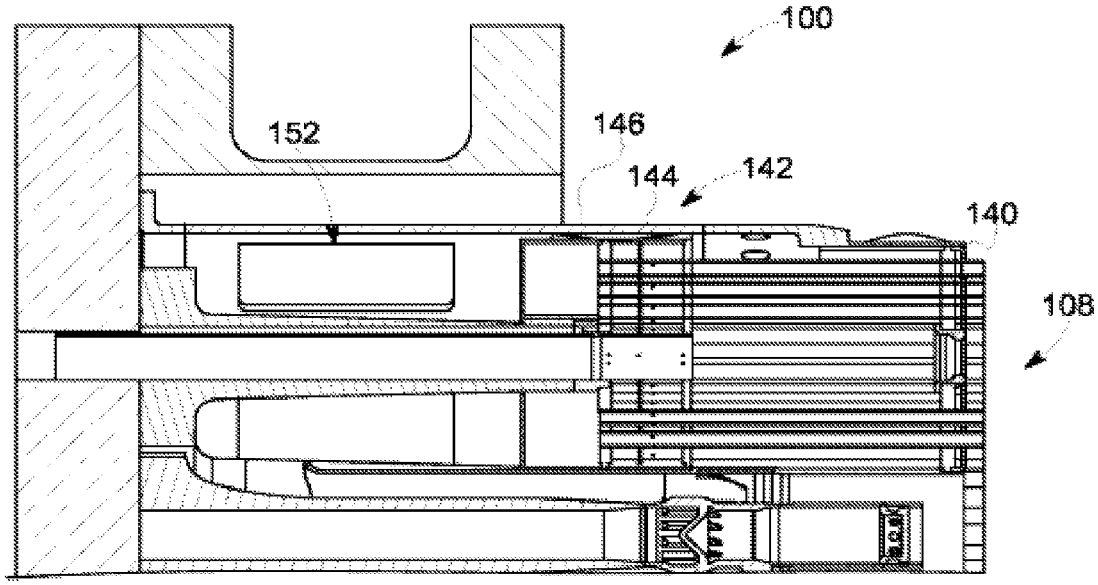
FIG. 7 is a cross-section of an example diagram of a portion of a micromixer, according to an embodiment.

As depicted in FIGS. 5-7, the micromixer 100 may include an end cap assembly 140 disposed about each of the segmented mixing tube bundles 108. The end cap assembly 140 may include a cap face 141 having a number of apertures 143 for corresponding segmented mixing tube bundles 108 to pass through. Sidewalls 145 may extend about the circumference of the cap face to form a lip. The end cap assembly 140 may provide additional support to the segmented mixing tube bundles 108. In certain embodiments, the end cap assembly 140 may be removable from the segmented mixing tube bundles 108 such that during maintenance, the end cap assembly 140 may be removed and segmented mixing tube bundles 108 may be replaced and the end cap assembly 140 put back on. In other embodiments, the end cap assembly 140 may be removeably attached to a support structure 146 encompassing the micromixer.

In certain embodiments, as depicted in FIGS. 6 and 7, the micromixer 100 may include one or more dampening mechanism 142 disposed about the micromixer 100. For example, the dampening mechanism 142 may include one or more hula springs 144. The hula spring 144 may be disposed between a segmented portion of the micromixer 100 and an outer support structure 146 of the combustor. The hula spring 144 may dampen the vibration associated with the combustor and provide additional support to the micromixer assembly. Moreover, the hula spring 144 may at least partially provide additional support to the segmented mixing tube bundles 108.

In certain embodiments, as depicted in FIGS. 6 and 7, a means may be provided to facilitate the turning of air within the micromixer. For example, in FIG. 6, a baffle 148 may be disposed within the airflow path of the mixromixer 100. In another example, as depicted in FIG. 7, the support structure 146 encompassing the micromixer 100 may include flared portions 152.

For each segmented portion of the micromixer, there is only one air side flow obstruction—the nozzle base structure. Accordingly, the present micromixer reduces the number of protrusions into the air flow path so as to facilitate a more uniform air feed in the mixing tubes.

A technical advantage of the present micromixer includes a more uniform air feed to the mixing tubes. Another advantage of the present micromixer is that it facilitates fuel feed distribution to the mixing tubes and does not require a complex base nozzle structure to support the micromixer assembly. This results in a micromixer assembly that has lower NOx emissions because the air and fuel distribution are more uniform. The overall cost of the micromixer may be less and it may be more reliable because the number of welds is reduced, the number of parts is decreased, and the analytical assessment is more straightforward.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A micromixer for a combustor having a combustion chamber, the micromixer comprising:

an end plate;

a plurality of base nozzle structures extending from the end plate, wherein each of the base nozzle structures comprise coaxial tubes comprising an inner tube and an outer tube;

a plurality of mixing tubes segmented into bundles of mixing tubes, wherein each bundle of mixing tubes is at least partially supported by one of the plurality of base nozzle structures, wherein the plurality of mixing tubes comprise a first end and a second end, and wherein the first end of the plurality of mixing tubes is spaced apart from the end plate to form an air passage about the plurality of base nozzle structures;

a plurality of fuel plenums, wherein each bundle of mixing tubes comprises one of the plurality of fuel plenums disposed around the bundle of mixing tubes downstream of the air passage and between the first end and the second end of the plurality of mixing tubes, wherein the outer tube of the coaxial tubes is in fluid communication with the respective fuel plenum, and wherein the inner tube of the coaxial tubes is in fluid communication with the combustion chamber;

a removable end cap assembly disposed about the plurality of mixing tubes; and wherein the plurality of base nozzle structures extend from the endplate in a circumferential array such that the air passage, the plurality of fuel plenums, and the segmented bundles of mixing tubes are positioned adjacent to one another to form a single, circular micromixer that exits an air/fuel mixture into the combustion chamber.

2. The micromixer of claim 1, wherein the outer tube of the coaxial tubes is configured to supply a fuel to the plurality of fuel plenums.

3. The micromixer of claim 2, further comprising one or more holes in a portion of the plurality of mixing tubes surrounded by the respective fuel plenum, wherein the fuel enters the plurality of mixing tubes by way of the one or more holes.

4. The micromixer of claim 1, further comprising an air conditioner plate disposed within the air passage upstream of the first end of the plurality of mixing tubes.

5. The micromixer of claim 1, further comprising an air baffle disposed adjacent to an air inlet upstream of the plurality of mixing tubes.

6. The micromixer of claim 1, further comprising a fuel conditioning plate disposed within the plurality of fuel plenums.

7. The micromixer of claim 1, wherein the plurality of mixing tubes supplies the combustion chamber with the air/fuel mixture.

8. The micromixer of claim 1, further comprising a dampening mechanism in contact with and disposed between the micromixer and an outer casing.

9. The micromixer of claim 8, wherein the dampening mechanism is a hula spring.

* * * * *